United States Patent [19]

Gildersleeve

[11] 4,179,265

[45] Dec. 18, 1979

[54] METHOD AND APPARATUS FOR OPERATING ROTARY DRIERS

[75] Inventor: Hayden P. Gildersleeve, Colorado Springs, Colo.

[73] Assignee: Holly Sugar Corporation, Colorado Springs, Colo.

[21] Appl. No.: 842,397

[22] Filed: Oct. 17, 1977

[51] Int. Cl.[2] ..... F27B 7/20; F27D 19/00

[52] U.S. Cl. ..... 432/36; 432/47; 432/106; 34/54

[58] Field of Search ..... 432/36, 37, 47, 103, 432/105, 106, 112, 113, 117; 34/51, 133, 54; 236/1 A, 1 H, 15 C; 110/246; 266/89, 173, 213

[56] References Cited

U.S. PATENT DOCUMENTS

| | | | |
|---|---|---|---|
| 3,021,126 | 2/1962 | Borgel | 432/47 |
| 3,146,821 | 9/1964 | Wuetig | 432/37 |
| 3,170,681 | 2/1965 | Davies | 432/47 |
| 3,302,937 | 2/1967 | Pixley | 432/106 |
| 3,522,663 | 8/1970 | Grimmelt et al. | 34/54 |
| 3,584,850 | 6/1971 | Brandvold | 432/106 |
| 3,595,544 | 7/1971 | Curtis | 432/37 |
| 3,610,596 | 10/1971 | Snyder | 432/47 |
| 3,614,074 | 10/1971 | Wellford, Jr. | 432/37 |

*Primary Examiner*—Henry C. Yuen
*Attorney, Agent, or Firm*—Horace B. Van Valkenburgh; Frank C. Lowe

[57] ABSTRACT

The pressure of heated gases supplied by a furnace to an induced draft, rotating drum drier, through which the material being dried is moved primarily by the heated gases, is compared with the pressure of gases discharging from the drum, and the differential between these pressures is used in controlling the induced draft of the drum by decreasing the draft upon an increase in differential pressure and increasing the draft upon a decrease in differential pressure. The differential in pressure may be maintained at a value on the order of 1.2 to 1.6 inches $H_2O$, depending on the installation. The induced draft may be controlled at a damper between a discharge chamber for the furnace and an induced draft fan, through an electro-hydraulic actuator acting through a lever and a rod, the lever being manually settable when automatic operation is not used. The signal for the actuator is produced by a load responsive control device to which a signal, corresponding to the differential pressure, is supplied from a pressure responsive transmitter, to which is connected both a pressure pipe extending from the furnace and a pressure pipe extending from the drum discharge chamber. The furnace pressure is also fed to an additional pressure responsive transmitter, for producing a signal proportional to the furnace pressure for transmittal to an override control device, which compares the signal with a preselected minimum furnace pressure.

21 Claims, 4 Drawing Figures

METHOD AND APPARATUS FOR OPERATING ROTARY DRIERS

This invention relates to a method of and apparatus for operating driers, and more particularly rotating drum type driers supplied with heated gases by a furnace.

This invention will be described by reference to pulp driers for drying pulp produced at sugar beet factories, but will be understood to be applicable to driers for drying other types of products, such as alfalfa, perlite, fertilizers, dog or cat food and other products.

BACKGROUND OF THE INVENTION

With the establishment of sugar beet factories early in the century, the pulp resulting from the extraction of sugar from the beets quickly became an important product for feeding cattle, initially by the same farmers who grew the beets. Thus, a beet grower would often deliver a load of beets to the factory and then wait to load his wagon with pulp for feeding to cattle. Such green or wet pulp was usually stored in large pits or silos at the factory, where it remained until it was needed, but this resulted in considerable losses and other problems. Thus, tests have indicated that as much as 65% of the original weight of beet pulp and 50% of its food value may be lost during a six months storage period. In addition, the decomposition and fermentation products of wet beet pulp stored in open pits are offensively odoriferous. Furthermore, as the beet growers' farms became located further and further away from the beet sugar factories, it was necessary to ship the beets to the factories, sometimes considerable distances, with the result that the growers were no longer located at a convenient distance for transporting pulp back to the farm. Since the beet pulp is a result of the slicing of beets into cossettes and the recovery of the sugar by diffusion into water, the resultant pulp is heavily loaded with water. Of course, a considerable portion of the water can be squeezed from the pulp by pressing, but even then the weight of the pulp is such that shipment for more than short distances is uneconomical. Thus, drying of the pulp permits more economical shipment of the pulp to a point of use, as well as overcoming storage loss and odor problems. Formation of the dried pulp into extruded pellets further reduces shipping and handling costs, since dried pulp pellets in bags requires one third to one fourth the storage volume for bulk pulp.

Pulp from the diffusion operation is transported to the presses by a conveyor or by additional water. In the latter instance, excess water is drained through screens prior to feeding into the press. Pressing of the pulp, which removes considerably more water than drying, is normally accomplished by screws surrounded by screens through which the water flows as the pulp is pressed. Such presses include the single screw press of a vertical type and the horizontal twin screw type. Pulp press water is normally returned to the diffusion equipment, sometimes with sterilization to reduce bacteria. Although the pulp drier normally removes a lesser amount of water than the press, the further reduction in water content of the pulp, as from 75% to 85% water on a weight basis, requires considerable energy. Thus, as indicated in the section entitled *Dried Pulp* of the book *Beet Sugar Technology* (2nd Ed. Beet Sugar Development Foundation 1971), of the total fuel required by an entire sugar beet factory, as much as 30% may be used in drying pulp. This fuel is normally natural gas or fuel oil, although some driers utilize coal and additional conversions to the use of coal as a fuel may be expected.

In order to increase the value of the dried pulp as a food supplement, various additions have been made to the pulp, primarily of products originating at the sugar factory. Thus, molasses has been added to the pulp, while concentrated filtrate solids from the Steffens house, as well as liquid protein concentrate, have been substituted for a portion of the molasses solids. The pulp with added molasses is referred to as "molasses dried" beet pulp, while pulp with molasses and Steffens filtrate is referred to as "molasses-CSF" beet pulp. In addition, at certain factories utilizing an ion exchange process, non-sugars removed by the ion exchange operation may be added to increase the mineral value of the pulp. The additives are normally added to the pulp, as by spraying, after pressing and prior to feeding to the drier.

A conventional beet pulp drier includes an induced draft, rotating, horizontal axis drum, as on the order of 7.5 feet to 12 feet in diameter and from 31.5 feet to 66 feet long. Drums of 10.5 feet in diameter and 48 feet long are generally considered to be able to dry the equivalent of 2500 tons per day of beets sliced, with smaller and shorter drums having lesser capacities and larger and longer drums having a greater capacity. The drums are equipped with shelves or flights around the inside periphery from which the pulp falls, as a shelf or flight approaches or reaches the top of the drum. However, these shelves or flights are not designed to move the pulp through the drum, so that the mixture of combustion products moving from the furnace through the drum is relied on to move dried or drying pulp from the entrance to the exit end of the drum. The furnace is stationary, so that a sealing section or sleeve between the furnace and the drum is normally utilized. The furnace is normally equipped with one or more burners, such as adapted to burn natural gas or No. 6 fuel oil, as at a 100,000,000 b.t.u. per hour rate for the 10.5 feet by 48 feet drum referred to above. In general, the pulp is dried to a moisture content of 4% to 12% in the final product, with some operators preferring a range of 6% to 8% and some others a range of 4% to 6%, although the latter would appear to be lower than desirable for making pellets.

From the pulp drier drum, the dried pulp and exhaust gases are normally moved into an upright discharge chamber in which the dried pulp settles to the bottom and the exhaust gases are discharged through the top. The inlet of an induced draft fan is normally connected to the upper outlet of the discharge chamber, while the outlet of the induced draft fan is connected to a pipe which transfers the exhaust gases to the cyclone separator, in which normally smaller particles of dried pulp, which have not settled in the discharge chamber, are removed. The dried pulp is removed, as by screw conveyors, from the bottom of each of the discharge chamber and the cyclone separator, for transfer to storage or otherwise, such as pelletizing equipment. Previously, the exhaust gases discharged from the cyclone separator, normally carrying a small amount of dust or fine particles, has been deemed unobjectionable for discharge into the atmosphere. More recently, environmental requirements have necessitated further treatment of the exhaust gases, as in a dust collection system. Water scrubbers have, so far, been the most reliable for removing dust from the exhaust gases in sufficient amounts to satisfy environmental requirements.

Since the temperature of the combustion gases from the burners of the furnace may be on the order of 3500° F. to 3800° F., or 1920° C. to 2090° C., it is desirable to cool the combustion products, to reduce the temperature of the hot gases entering the drum to a temperature on the order of 900° F. to 1500° F., although higher temperatures have been used, but with a greater possibility of pulp combustion in the drum. The exit temperature of the flue gases is reported to vary from 220° F. to 280° F., or 154° C. to 188° C., depending on the installation, while an increase in over all efficiency has been produced by recirculating to the furnace, for cooling the combustion gases, a portion of the exhaust gases rather than ambient air. When a portion of the exhaust gases are returned to the furnace, a connection for this purpose is normally made at the outlet of the cyclone separator. An added advantage of this recirculation is that the reduction of the oxygen content of the gases passing from the furnace decreases the possibility of degradation of the product by oxidation or the combustion of dried pulp, as well as elimination of fine particulates from the stack gases by burning in the furnace.

With the diffusion system operating at capacity and constant supply of pulp being supplied to the presses, the supply of pressed pulp to the drier drum should be essentially constant. However, there are many circumstances which may affect not only the amount of pulp supplied to the drum, but also the moisture content of that pulp. For instance, a change in the acidity of the pulp has been determined as affecting the moisture in the pulp. As a matter of fact, at some plants, acid has been added to the pulp to decrease the amount of moisture in the pulp resulting from pressing. Thus, sulfuric or muriatic acid has been added to adjust to about 5.5 the pH of the pulp liquid about to be discharged from the diffusion system. In addition, microbiological action has been permitted to take place in the diffuser to acidify the pulp. While the action of the latter may cause a loss of sugar in the diffusion juices, this loss may be less than either the cost of the fuel to evaporate the additional water in the pulp drier, or the cost of the addition of sulfuric or muriatic acid to adjust to the same pH. Other additives for the wet pulp which have been used to improve the pressed pulp moisture content include calcium chloride and alum, while the returned pulp press water has also been sterilized by $SO_2$ to increase acidity. In addition, the pulp may be softer or mushier at one time than another, which tends to result in a higher moisture content, a condition which is also produced from pulp which is too firm. It has been reported that there is a linear correlation between the diffusion battery temperature and the pressed pulp moisture content. Nevertheless, in general, when conditions are such that lower pulp losses and high purity diffusion juices are obtained, the pulp drier operation should be more satisfactory.

The theory of drying pulp is that drying is an evaporation step in which the latent heat of the evaporation moisture in the pulp is supplied by the sensible heat of the hot gases in the drier drum. Thus, a gradient is established between moisture at the surface and the interior of the pulp particles, particularly at the feed end of the drier, when the pulp is wet. Apparently, with sufficient water present, the rate of diffusion of water from the interior of the pulp particles to the surface is rapid enough to maintain the surface in the wet condition, so that evaporation takes place at a temperature below the wet bulb temperature. As the pulp loses moisture, in moving along the drum, the temperature of the drying gases decreases, while the temperature of the pulp tends to increase. Thus, at discharge, the pulp temperature may approach the temperature of effluent gas, although, many times, the pulp temperature may be as much as 100° F. below the wet bulb temperature, which may be in the range of 180° F. to 200° F. for a direct fired drier. Nevertheless, the temperature of the pulp may be as low as 140° F., even though the entering flue gases may be at 1200° to 1500° F.

The evaporation of water from the pulp particles appears to tend to take place at a generally constant rate as long as the pulp remains below the wet bulb temperature, i.e. sufficiently wet therefor. However, when the surface of the pulp particles become drier with a reduction in water content, the evaporation rate decreases and the temperature of the surface of the pulp particles is increased. Fortuitously, the temperature of the drying gas is decreased much lower at the exit end of the drier, so that the increase in the temperature of the pulp is curtailed.

Another factor affecting the drying of pulp is the proportion of small, thin particles of pulp which tend to lose their moisture much more rapidly than larger particles. Such a particle of pulp is heated readily to the temperature of the incoming gases at the entrance end of the drum, which temperature may exceed 1000° F., and such small, thin particles may tend to burn. A counteracting factor is the tendency of the small, thin particles, when dried, to lose considerable weight and thus to be transported quickly by the drying gases to the discharge end of the drum. It has been generally believed that the amount of drying which will take place is proportional to the amount of fuel used by the furnace. Thus, drum driers have been controlled for many decades through an increase in the amount of fuel, when the discharge temperature of the exhaust gases just beyond the drum decreases. Similarly, it has been the practice to decrease the amount of fuel when the temperature of the exhaust gases increases. In general, it is believed that the greatest fuel economy is realized when the pulp drier drum is operating close to its maximum capacity, the reasoning being that the increase of fuel per unit of air or recirculated gas fed to the drier causes a greater temperature difference, which in turn increases the rate of evaporation. Nevertheless, total losses in the drum tend to increase as the rate of evaporation increases. It has also been indicated by tests that the pressed pulp treated with molasses is more susceptible to loss in the drum, although the pulp with molasses does not appear to greatly alter the rate of drying but may tend to extend the zone of an essentially constant drying rate. Nevertheless, the addition of molasses appears to reduce the actual load on the drum, calculated on the basis of bags of dried pulp produced, since the molasses treated pulp contains a higher proportion of dry substance which more nearly approaches that of the dried pulp.

The desirability of effective control of the pulp drying process has been recognized for years. The earlier method of controlling the pulp drier process involved manual control by the operator, principally by increasing the fuel supplied to the furnace, increasing the air supplied by the forced draft fan for the furnace and increasing suction of the induced draft fan for the pulp drier when the pulp became wetter. This manual control was based primarily upon the "feel" of the dried pulp, i.e. an estimate, based upon the operator's experience, of the percent moisture in the dried pulp. Automatic controls have been utilized to regulate the amount of fuel fed to the furnace, with a corresponding control of the forced draft fan, in accordance with the temperature of the heated gases discharged from the drier, normally measured at the outlet of the induced draft fan, but sometimes measured in the drier discharge chamber. This type of control operates very well when there are only small load fluctuations, but leaves much to be desired when the load fluctuations are greater. Attempts have also been made to develop a device for measuring the water content of the dry pulp, such as based on infra red, microwave and electrical conductivity measurements, but these have not been successful. A computer control based upon a weighing mechanism which continually weighed the entering pulp has also been developed, but the expense of the use of this computerized equipment tends to overshadow the savings which might be made thereby. While it has been recognized that the differential in pressure between the furnace and the discharge of the pulp drier is related to the load on the pulp drier, no use has been made of this factor. Thus, in the section entitled *Dried Pulp* of *Beet Sugar Technology,* supra, it is stated: "A temperature controller that would alter its control point in direct relation to change in the load is needed." However, there is no suggestion of how such a controller should be made.

Among the objects of this invention are to provide a method of and apparatus for controlling the operation of a rotating drier supplied with hot gases, which method and apparatus are particularly responsive to variations in load; to provide such a method and apparatus which will produce a more uniform moisture content of the product; to provide such a method and apparatus which will reduce the amount of fuel used and concommitantly reduce the cost thereof; to provide such a method and apparatus which involves equipment, the cost of which may be recovered through fuel savings in a comparatively short time; to provide such a method and apparatus which is not only efficient but also effective at substantially all times; to provide such a method and apparatus which may be used with greater safety; and to provide such a method and apparatus which will have additional advantages.

SUMMARY OF THE INVENTION

In accordance with this invention, the differential in pressure between the furnace and the discharge from the pulp drier drum is utilized to control the induced draft for the drier drum, as by control of opening and closing of the induced draft damper. This control is made automatically, thus avoiding reliance upon the operator, but is effected in a manner exactly opposite to that which would be expected to be successful. Thus, if the pulp load increases, it would be expected that an increase in the flow of gases through the drum would be necessary. However, it has unexpectedly been found that precisely the opposite becomes operative, in utilizing the above pressure differential as the principal control factor. Thus, if the differential in pressure between the furnace and the drier drum exhaust increases, indicating a greater pulp load in the drum, in accordance with this invention, the induced draft damper is moved toward closed position to reduce the flow of gases from the drum. Similarly, if this pressure differential decreases, indicating a decrease in the load on the drum, the induced draft damper is moved toward open position to increase the flow of gases from the drum. In general, the differential in pressure between the furnace and the drier drum discharge is maintained at 1.5 inches of water, or between desirable limits, determined by tests to be generally on the order of 1.2 inches of water to 1.6 inches of water for sugar beet pulp driers. While the induced draft fan damper is the most convenient place for the control with present installations, it will be recognized that the control may be applied to the induced draft fan itself.

Apparatus of this invention may include an actuator having a pneumatic or hydraulic motor which is link connected with the induced draft damper and controlled by a signal receiving device, such as electrical or electronic, from a load responsive controller to which is supplied a signal indicating the differential in pressure between the furnace and the exhaust drum gases. The latter signal is produced by a pressure responsive transmitter to which the actual pressure is fed through separate tubes, each connected with a pressure responsive device, or tube end, one at the furnace or the sleeve connecting the furnace with the drum and the other at the discharge chamber connected to the drum or a correspondingly appropriate position. The signal from the load responsive controller may instead be utilized to vary the speed of the induced draft fan.

The above method and apparatus permits a fuller utilization of the capacity of the drier drum, since the movement of the induced draft damper toward closed position reduces the rate of flow of gases to the drum and provides a greater retention time for the pulp, thereby accommodating a greater pulp load. When the retention time is increased, the temperature of the gases exhausted from the drier drum will be decreased, thereby enabling the amount of fuel necessary to dry the pulp to be reduced. Also, the quality of the dried pulp has been improved, with a substantial reduction or even absence of charred particles which result from uneven distribution in the drum. With the reduction or absence of charred particles, a reduction in the pulp drier stack emissions has resulted, although there appears still to be need for further treatment of the gases, in order to provide adequate environmental standards. The increase in retention time also reduces the temperature of the exhaust gases, as on the order of 10° C., thus producing a corresponding reduction in the fuel necessary.

The control of the amount of fuel supplied to the furnace, in reverse proportion to the temperature of the gases discharged from the drier drum, such as measured in the pipe leading from the induced draft fan to the cyclone separator, is also utilized because it has been found that this temperature control has a synergistic effect with respect to the essentially pressure control feature of this invention, insuring that the advantage of the reduced temperature of the exhaust gases, due to the increased retention time of the pulp, will be obtained in a reduction of fuel. Since the pulp load responsive control of this invention produces a reduction in the temperature of the exhaust gases, the exhaust temperature control point for increase or decrease of fuel is reduced accordingly.

It has also been found desirable to provide an override control for the pressure control of this invention, in order to maintain the pressure in the furnace below atmospheric, with the override point being set at a negative pressure, as of a value of −0.5 to −0.5 inches water, depending upon the installation. Since the pressure at the exhaust end of the drum is normally relatively stable, an increase in the differential in pressure between the furnace and the drum exhaust generally means that the pressure in the furnace has increased, i.e. has attained a lesser negative value, which may tend to approach atmospheric. For this reason, in order to insure that the furnace pressure will not reach atmospheric, it has been found desirable to restrain further closing of the induced draft damper when the furnace pressure increases to a predetermined negative value. Additional apparatus for utilizing this feature includes a separate pressure responsive transmitter to which the actual furnace pressure is fed, from the same pressure responsive device referred to above, and which produces a signal, such as electrical or electronic, proportional to the furnace pressure and transmitted to an override controller which is preset to act when the furnace pressure rises to a predetermined negative value. Such an override controller produces a signal for the load responsive controller which overrides or prevents production of a signal from the load responsive controller to the actuator to reduce the opening of the induced draft damper.

THE DRAWINGS

DESCRIPTION OF THE PREFERRED EMBODIMENT

Figure 1:
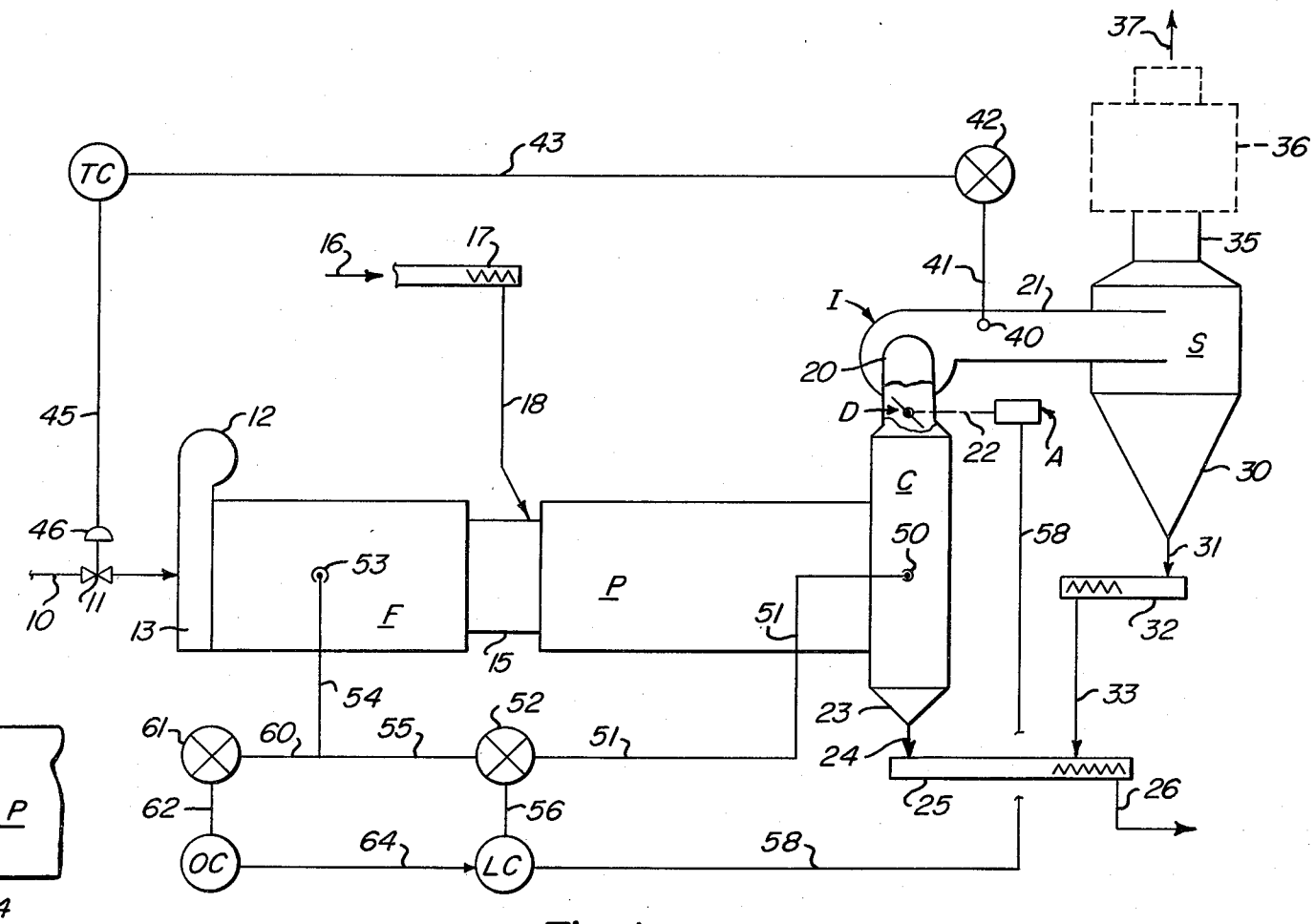
FIG. 1 is a schematic representation of a pulp drying system for a sugar beet factory, including apparatus of and utilized in carrying out the method of this invention.

A pulp drying installation to which the method of this invention is applied, as shown in FIG. 1, includes a furnace F to which fuel, such as fuel oil or gas, is supplied through a fuel line 10, the flow to the furnace being controlled by a valve 11 and the fuel being supplied to a conventional burner or burners (not shown). Air to provide oxygen for combustion of the fuel is supplied by a forced draft fan 12, the discharge of which is connected to a furnace inlet 13. The furnace supplies combustion gases for drying pulp in the rotating pulp drier drum P, which is cylindrical and is rotated about a horizontal axis by conventional means (not shown). The drum is provided on the inside with conventional flights or shelves for moving the pulp upwardly and then dropping the pulp in the central area between the edges of the shelves, for engagement by the heated gases for both drying and movement along the drum. Since the furnace is stationary and the drum is rotated, a connection pipe or cylinder 15 is conventionally disposed between the furnace and the drum, with a conventional seal, not shown, between the pipe 15 and the drum.

Figure 2:
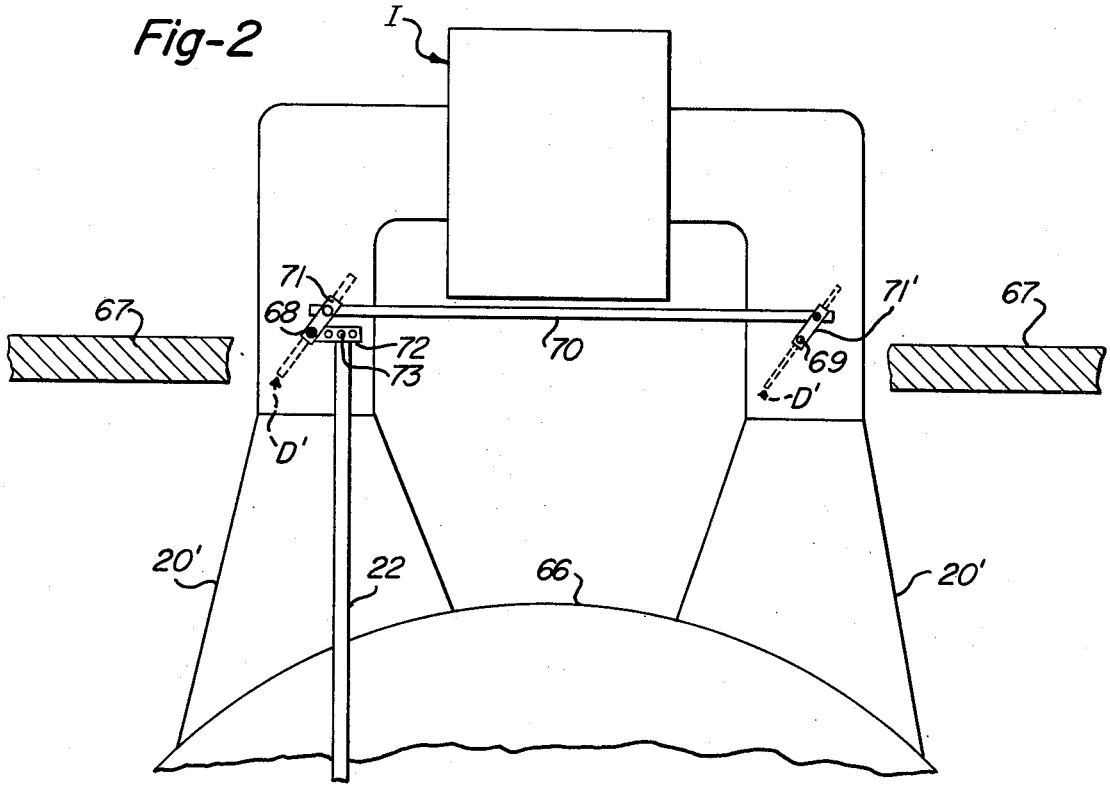
FIG. 2 is a partly diagrammatic end elevation of the upper end of a discharge chamber for a drier drum, showing a system operated by a control rod for adjusting the position of one or more dampers to control the flow of exhaust gases from the drier drum.

Pressed beet pulp, as indicated by the arrow 16, is supplied from the pulp press referred to previously to a pressed pulp conveyor 17, from which an inlet line 18 extends through connection pipe 15, which is stationary, to a conventional position for discharging the pressed pulp into the rotating drum. From the pulp drum P, the dry pulp moves into an upright discharge chamber C which is provided with an upper outlet 20 of reduced size, in turn connected to an inlet of an induced draft fan I, as of the centrifugal type and normally operated at a constant speed. The outlet of fan I is connected by a pipe 21 with the inlet of a cyclone separator S. A damper D is positioned in the upper outlet 20 and may be turned to different positions to decrease or increase the flow of gases from the discharge end of the drum, such as toward a closed position in which it extends across the outlet, or toward an open position in which it extends vertically of the outlet. The damper may be of the butterfly type indicated, or other suitable type, such as a series of parallel vanes, and is moved by a conventional crank (not shown) through a rod 22 connected to an actuator A, either electric or hydraulic or a combination thereof. One suitable construction for the actuator A is shown in FIG. 2. The discharge chamber C is provided with a lower converging discharge outlet 23 from which the dried pulp discharged through line 24 feeds into a conveyor 25 from the opposite end of which the dried pulp may be discharged by a line 26 to a point of storage or otherwise, such as pelleting equipment. From the lower cone 30 of the cyclone separator S, the collected, separated pulp particles may be fed through a discharge line 31 into a screw conveyor 32, from the opposite end of which the collected pulp particles are fed by a transfer line 33 into the conveyor 25 for addition to the dried pulp collected in chamber C.

The outgoing gases from the cyclone separator S pass upwardly through an outlet 35 and are thence led to a dust collection system 36, from which the exit gas 37 is discharged into the atmosphere. As indicated previously, the dust collection system 36 will normally be a wet scrubber system and thus located to one side of, rather than directly above the cyclone separator. As also indicated previously, when exhaust gases are recirculated to the furnace, takeoff would normally be from the stack 35 of the cyclone separator, it being understood that a pulp drying system to which the method of this invention is applied may very well include a recirculation of exhaust gases to the furnace.

The system is provided with a conventional exhaust gas temperature—fuel control including a temperature responsive unit 40, such as a thermocouple, in the pipe 21 leading from the outlet of the induced draft fan I and a lead 41 extending to a temperature transmitter 42, which essentially amplifies the temperature responsive signal given by the element 40. The temperature transmitter 42 is connected by a lead 43 with a temperature responsive controller TC, such as responsive to the temperature indicated by the signal transmitted through lead 43, and means for utilizing that signal to control the pressure in a pneumatic or hydraulic line 45 extending to a diaphram control device 44 for valve 11. As indicated previously, if the temperature of the exhaust gases in the pipe 21 exceeds a predetermined temperature, the amount of fuel is automatically decreased, but if the temperature falls below the predetermined temperature, the amount of fuel is increased, normally in proportion to the deviation from the predetermined temperature. However, the temperature control point may be set considerably lower when this invention is used, since the exhaust gas temperature, at full load, is reduced. A reduction of 10° C. in this temperature set point has been accomplished in installations using this invention.

Figure 4:
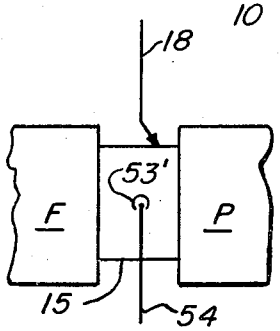
FIG. 4 is a fragmentary schematic representation corresponding to a portion of FIG. 1, but showing an alternative location of a pressure responsive element.

The control equipment for carrying out the most highly significant feature of this invention includes a pressure responsive element 50, such as an open tube extending into the discharge chamber C at a position corresponding to the center of the drum but, of course, at the periphery of the chamber. This position of the pressure responsive element should be such that the pressure at such position reflects as accurately as possible the pressure at the discharge end of the drum. From element 50, a hollow tube 51 extends to a pressure responsive transmitter 52, in essence, a device which will reflect the differential in pressure between the furnace and the discharge of the drum and produce a signal corresponding thereto. It will be noted that each of these pressures is essentially a vacuum or negative pressure. The system also includes a similar pressure responsive element 53 mounted centrally of the furnace and on the periphery opposite the horizontal centerline, again at a position to reflect as accurately as possible the pressure within the furnace, although the element 53 may be positioned in the pipe or cylinder 15 as at 53' in FIG. 4. A tube 54 connects with a branch tube 55 to transmit pressure within the furnace to the pressure responsive transmitter 52, which in turn transmits the signal, such as electrical or electronic, corresponding to the differential in pressure between the furnace and the drum discharge, through a control lead 56 to a load responsive controller LC. In turn, controller LC is connected by a lead 58, for supplying a signal, such as electrical or electronic, to the actuator A, which in turn causes the damper D to be moved toward open or closed position in accordance with the signal received. The actuator A may have either hydraulic or pneumatic mechanism for moving the rod 22, one suitable construction being shown in FIGS. 2 and 3 and described below.

The pressure within the furnace is also transmitted from tube 54 through a branch tube 60 to a pressure responsive transmitter 61, which is set to sense increases in the pressure, e.g. decreases in vacuum, within the furnace to a predetermined value to insure that the pressure within the furnace remains negative and does not approach atmospheric pressure too closely. The value of the furnace pressure is relayed by a signal sent through a line 62 from the pressure responsive transmitter 61, such as electrical, to an override controller OC. When the pressure within the furnace reaches the predetermined negative pressure or vacuum, approaching atmospheric pressure, an override signal is transmitted through a control line 64 to the pulp load responsive controller PC, which prevents any further closing of the damper. Controllers OC and PC may also be constructed so that any further increase in furnace pressure, i.e. a decrease in the vacuum, will produce a signal for moving the damper toward open position, in order to increase the air flow through the furnace and drier drum. As soon as the furnace pressure is reduced to a permissible value, the override controller OC releases the load responsive controller LC and the movement of the damper is again controlled through an increase or decrease, as the case may be, in the differential pressure between the furnace and the drum exhaust.

Figure 3:
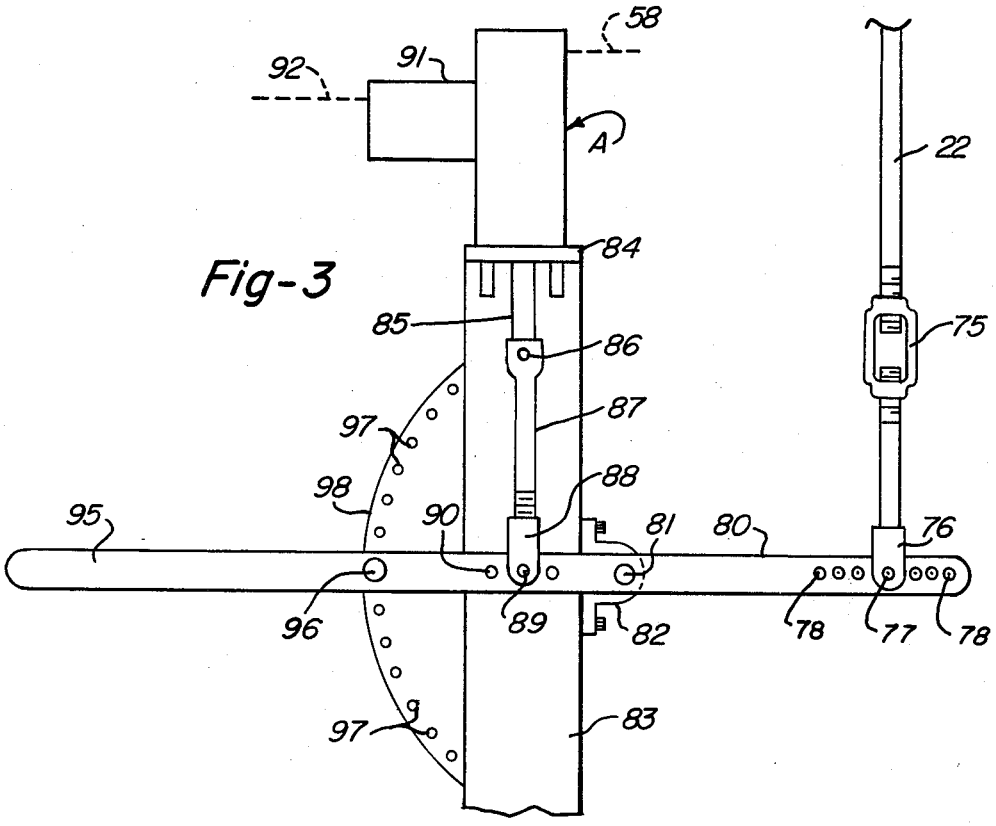
FIG. 3 is a side elevation, partly diagrammatic, of one construction of an actuator and adjustment system for controlling the damper adjustment rod.

As in FIG. 2, the induced draft fan I may be provided with an inlet at each side to which a branch 20' of the outlet from the upper end 66 of the discharge chamber C extends, with a damper D' in each branch. These outlet branches normally extend through a floor or platform 67 on which the induced draft fan and its motor (not shown) are supported, while the dampers D' are movable about a respective pivot 68 and 69. The prior installation included a manually movable cable running over a sprocket wheel attached to pivot 68 for turning the dampers, with the prior cable extending downwardly and around a hand wheel at an appropriate position for the operator. The opposite damper is turned in synchronism with the damper mounted on pivot 68 by a bar 70 pivotally connected between arms 71 and 71' attached to the respective pivots 68 and 69. In accordance with this invention, a pivot arm 72 is attached to the pivot 68 and is provided with holes, as shown, for inward or outward adjustment of a pin 73 connecting the upper end of a rod 22, which extends downwardly and the lower end of which is shown in FIG. 3. As in the latter, a turnbuckle 75 is installed in the lower end of rod 22 for adjustment of the length thereof, while the lower end of rod 22 is provided with a yoke 76 through which a pin 77 may be placed, for engagement with one of a series of holes 78 in one outer end of a lever 80, the opposite end of which may be used for manual adjustment of dampers D', as in a manner described below. Lever 80 is pivotal about a pin 81 mounted on a bracket 82, in turn mounted on a column 83, which may be placed at an appropriate position, such as rearwardly of the discharge chamber C. Mounted on a shelf type bracket 84, atop the column 83, is the actuator A from which a stem 85 extends downwardly to a pivot connection 86 for a stem extension 87 having a yoke 88 adjustable lengthwise by a threaded connection, as shown, and through which a pin 89 may be placed to connect the yoke with the lever 80 in one of a series of holes 90. For instance, the hole 90 in which the pin 89 is installed, as shown, may be on the order of 6 inches from the lever pivot pin 81, while the hole 78 at the outer end of the lever in which pin 77 is installed, as shown, may be on the order of 18 inches from the main pivot pin 81, so as to produce a 1:3 ratio between movement of stem 85 and the movement of rod 22. The next inner hole 90 and next inner hole 78, when connected by pins 89 and 77, respectively, may provide a 1:4 ratio, with a similar difference in the ratio for each setting of pin 89 in one of the holes 90 and the setting of pin 77 in one of the holes 78. Control lead 58 supplies a 4–20 milliampere signal to actuator A having an integral motor 91 for producing movement of pin 85 and supplied by a line 92 with appropriate current, as at 120 volts A.C.

In order to permit the operator to adjust the induced draft dampers D', when automatic operation is not being used, as indicated previously, the end 95 of lever 80 opposite rod 22 may be moved by the operator to produce the necessary mechanical advantage. With automatic operation, the lever 80 is maintained in position until a change is called for, but in manual operation, it is desirable to permit the operator to lock the lever in an adjusted position, such as by placing a pin 96 in a hole provided therefor in the lever and an appropriate hole of a series of holes 97 disposed in an arc centered about lever pivot pin 81 and formed in an arcuate disc 98, attached to the opposite side of column 83.

For a commercial installation which has been successfully operated, the results shown in Table I below were obtained during a five week period of manual control and a subsequent six week period of pulp load control or automatic control of the induced draft damper in accordance with this invention. This control was applied to three drum driers, each 10.5 feet in diameter and 48 feet long, each designed to dry the equivalent of 2500 tons per day of beets sliced and each equipped with Coen burners capable of firing natural gas or No. 6 fuel oil at a 100,000,000 B.T.U. per hour rate. The comparative figures shown are fuel on pulp as a percentage, which is a figure used in factory operations, computed daily and averaged weekly.

Table I

| | Fuel on Pulp % | | |
|---|---|---|---|
| Week | Manual Control | Week | Pulp Load Control |
| Fifth Prior | 93.6 | First | 84.6 |
| Fourth Prior | 90.7 | Second | 76.2 |
| Third Prior | 88.6 | Third | 82.4* |
| Second Prior | 90.3 | Fourth | 75.6 |
| First Prior | 92.8 | Fifth | 74.5 |
| | | Sixth | 71.2 |
| Average | 91.23 | | 77.39 |

*Higher than normal pressed pulp moisture.

The steady decline in fuel consumption, when utilizing pulp load control in accordance with this invention, is evident. It is noted that, during the third week of pulp load control, problems with diffusion operations caused pressed pulp moistures to exceed 84% for several days, but even then the fuel required was less for that week than for any week in which manual control was utilized. The resultant savings in fuel, as a percentage, was calculated as follows:

$$100 - \frac{77.39}{91.23} \times 100 = 15\% \quad (1)$$

On the basis of the prior nominal consumption of fuel at the rate of 6,000,000 cubic feet of gas per day at a cost of $1.52 per thousand cubic feet, the savings for a 90 day campaign would be calculated as follows:

$$6000 \times \$1.52 \times 90 \times 0.15 = \$123,120 \quad (2)$$

It was also calculated that the cost of instrumentation and parts for converting to pulp load control in accordance with this invention, at which the results set forth in Table I were obtained, was recovered through fuel savings in two weeks of operation. In this installation, the pressure tubes 51, 54, 55 and 60 of FIG. 1 were half inch pipes, while the pressure responsive transmitter 52 was a Taylor Instrument Company catalog No. 1301TD21125 Electronic Differential Pressure Transmitter having an adjustable span of from 0 to 1 inch water to 0 to 10 inches water, a range of 0 to 3 inches water and an output of 4 to 20 milliamperes D.C. The same instrument was used as pressure responsive transmitter 61, but calibrated differentially for its function. The load responsive controller LC was a Taylor Instrument Co., catalog No. 1312RA10024 Electronic Indicating Controller having a proportional and reset mode, a 0–10 uniform scale, an input of 4 to 20 milliamperes D.C. and an output of 4 to 20 milliamperes D.C. The override controller OC was a Taylor Instrument Company catalog No. 1311RA10004 Electronic Indicating Controller having a proportional mode, a 0–10 uniform scale, an input of 4 to 20 milliamperes D.C. and an output of 4 to 20 milliamperes D.C. In addition, a two pen recorder was connected to control line 56, for one pen, and to control line 62, for the other pen, to produce a record of the differential in pressure between the furnace and discharge chamber, by the first pen, and a record of the furnace pressure by the second pen. This recorder was a Taylor Instrument Company catalog No. 1322JA14120 Two Pen Electronic Recorder having an input of 4 to 20 milliamperes, a 1–10 uniform scale and a chart having 1–10 uniform spaces and movable at 1 inch per hour. The actuator A was an ITT General Control Type AH94 Milliampere Hydramotor Actuator with Electro-Hydraulic Operation, receiving power at 120 volts A.C. at 60 Hertz and a control signal of 4 to 20 milliamperes D.C. The stroke was 3.5 inches and the stem output was 3000 pounds.

Although a preferred embodiment of this invention has been illustrated and described and variations therein indicated, it will be understood that other embodiments may exist and that various changes may be made, particularly in the application thereof to induced draft, rotating drum driers supplied with heated gases for drying materials other than pulp, without departing from the spirit and scope of this invention.

What is claimed is:

1. A method of controlling the operation of a drier having an induced draft, elongated rotating drum supplied with heated gases, a product to be dried being supplied to the intake end of the drum and moved to the discharge end of the drum generally by said gases, said method comprising:

determining the pressure of gases supplied to said drum;

determining the pressure of gases discharging from said drum;

determining the differential in pressure between the pressure of the supply gases and the discharge gases; supplying the determination of the differential in pressure to a control device and controlling, through said control device, the induced draft of said drum by variations in said pressure differential by decreasing said draft upon an increase in said differential pressure and increasing said draft upon a decrease in said differential pressure.

2. A method as defined in claim 1, wherein said heated gases are supplied by a fuel burning furnace and wherein the pressure in said furnace corresponds to the pressure of heated gases supplied to said drum, which includes:

determining the temperature of the exhaust gases from said drum;

increasing the amount of fuel supplied to said furnace upon a decrease in said temperature; and decreasing the amount of fuel supplied to said furnace upon an increase in said temperature.

3. A method as defined in claim 1, wherein the product to be dried is a pulp and which includes:

maintaining said differential pressure at a value of on the order of approximately 1.2 to 1.6 inches of water.

4. A method as defined in claim 1, wherein:

a discharge chamber receives exhaust gases and said product for settling of said product in said chamber; and determining the pressure of gases discharging from said drum within said discharge chamber.

5. A method as defined in claim 1, wherein:

said furnace is connected to said drum by a stationary cylinder, and which includes:

determining the pressure of gases supplied to said drum in said cylinder.

6. A method of controlling the operation of a drier having an induced draft, elongated rotating drum supplied with heated gases, wherein a product to be dried is supplied to the intake end of the drum and moved to the discharge end of the drum generally by said gases, wherein said heated gases are supplied by a fuel burning furnace and wherein the pressure in said furnace corresponds to the pressure of heated gases supplied to said drum, said method comprising:

determining the pressure of gases supplied to said drum;

determining the pressure of gases discharging from said drum;

determining the differential in pressure between the pressure of the supply gases and the discharge gases;

controlling the induced draft of said drum by variations in said pressure differential by decreasing said draft upon an increase in said differential pressure and increasing said draft upon a decrease in said differential pressure; and overriding the control of said induced draft to restrain further reduction in said draft when the pressure in said furnace increases to approach atmospheric within a predetermined amount.

7. A method as defined in claim 4, which includes:

overriding said control of said induced draft for said drum when the pressure in said furnace increases to a value of approximately −0.15 to −0.5 inches of water.

8. A method as defined in claim 6, which includes:

determining the temperature of the exhaust gases from said drum;

increasing the amount of fuel supplied to said furnace upon a decrease in said temperature; and decreasing the amount of fuel supplied to said furnace upon an increase in said temperature.

9. A method as defined in claim 8, which includes:

resetting the temperature control point for increasing and decreasing the amount of fuel supplied to said furnace in accordance with the reduction in the temperature of the exhaust gases produced by controlling the induced draft.

10. A method of controlling the operation of a drier having an induced draft, elongated rotating drum supplied with heated gases, wherein a product to be dried is supplied to the intake end of the drum and is moved to the discharge end of the drum generally by said gases, wherein said gases from said drum exhaust into a settling chamber, wherein said induced draft is produced by an induced draft fan within an outlet connected to a gas exhaust connection for said chamber and wherein movable damper means is disposed in said conduit between said chamber and said fan, said method comprising:

determining the pressure of gases supplied to said drum;

determining the pressure of gases discharging from said drum;

determining the differential in pressure between the pressure of the supply gases and the discharge gases;

controlling the induced draft of said drum by variations in said pressure differential by decreasing said draft upon an increase in said differential pressure and increasing said draft upon a decrease in said differential pressure; and controlling the position of said damper means in order to control the induced draft of said drum by moving said damper means toward closed position to decrease said induced draft and moving said damper means toward open position to increase said induced draft.

11. A method as defined in claim 10, wherein said heated gases are supplied by a fuel burning furnace and wherein the pressure in said furnace represents the pressure of heated gases supplied to said drum, which includes:

determining the temperature of said exhaust gases in said conduit beyond said fan; and controlling the amount of fuel supplied to said furnace in accordance with said temperature by decreasing the amount of fuel upon an increase in said temperature and increasing the amount of fuel upon a decrease in said temperature.

12. Apparatus for controlling the operation of a drier having an induced draft, elongated rotating drum supplied with heated gases, wherein a product to be dried is supplied to the intake end of the drum and moved to the discharge end of the drum generally by said gases, wherein said heated gases are supplied by a fuel burning furnace and wherein the pressure in said furnace corresponds to the pressure of heated gases supplied to said drum, said apparatus including:

means for determining the pressure of gases supplied to said drum;

means for determining the pressure of gases discharging from said drum;

means for determining the differential in pressure between the pressure of the supply gases and the discharge gases;

means for controlling the induced draft for said drum by variations in said pressure differential by decreasing said draft upon an increase in said differential pressure and increasing said draft upon a decrease in said differential pressure; and means for overriding the control of said induced draft to restrain further reduction in said draft when the pressure in said furnace increases to approach atmospheric within a predetermined amount.

13. Apparatus as defined in claim 11, which includes:

means for determining the temperature of the exhaust gases from said drum; and means for controlling the amount of fuel supplied to said furnace in accordance with said temperature by increasing the amount of fuel upon a decrease in said temperature and decreasing the amount of fuel upon an increase in said temperature.

14. Apparatus as defined in claim 12, wherein a discharge chamber receives exhaust gases and said product for settling of said product in said chamber, and including:

means for determining the pressure of gases discharging from said drum within said discharge chamber.

15. Apparatus as defined in claim 12, wherein said furnace is connected to said drum by a stationary cylinder, and including:

means for determining the pressure of gases supplied to said drum in said cylinder.

16. Apparatus for controlling the operation of a drier having an induced draft, elongated rotating drum supplied with heated gases, wherein a product to be dried is supplied to the intake end of the drum and moved to the discharge end of the drum generally by said gases, wherein said drum gases from said drum exhaust into a settling chamber, wherein said induced draft is produced by an induced draft fan within an outlet connected to a gas exhaust connection for said chamber and wherein movable damper means is disposed in said conduit between said chamber and said fan, said apparatus including:

means for determining the pressure of gases supplied to said drum;

means for determining the pressure of gases discharging from said drum;

means for determining the differential in pressure between the pressure of the supply gases and the discharge gases;

means for controlling the induced draft for said drum by variations in said pressure differential by decreasing said draft upon an increase in said differential pressure and increasing said draft upon a decrease in said differential pressure; and means for controlling the position of said damper means in order to control the induced draft of said drum by moving said damper means toward closed position to decrease said induced draft and moving said damper means toward open position to increase said induced draft.

17. Apparatus as defined in claim 16, wherein said heated gases are supplied from a fuel burning furnace to said drum, which includes:

means for determining the temperature of said exhaust gases in said conduit beyond said fan; and means for controlling the amount of fuel supplied to said furnace in accordance with said temperature by decreasing the amount of fuel upon an increase in said temperature and increasing the amount of fuel upon a decrease in said temperature.

18. Apparatus as defined in claim 16, wherein:

said means for determining the pressure of gases supplied to said drum includes a first hollow pipe extending into the interior of said furnace or into a conduit connecting said furnace to said drum and means responsive to the pressure transmitted by said first hollow pipe;

said means for determining the pressure of gases discharging from said drum includes a second hollow pipe extending into the interior of said settling chamber and means responsive to the pressure transmitted by said second hollow pipe;

said means for determining said differential in pressure includes a device having said responsive means and means for producing a signal proportional to the difference in said pressures;

said means for controlling the induced draft of said drum includes a device which receives said proportional signal and transmits a control signal which reflects a variation in said proportional signal from a preselected value representing a desired differential in said pressures; and means responsive to said control signal for varying said induced draft.

19. Apparatus as defined in claim 18, wherein:

said means responsive to said control signal includes an actuator which produces a movement of a movable element in proportion to the variation in said control signal; and said movable element is constructed and arranged to produce movement of said damper means.

20. Apparatus as defined in claim 19, including:

a pivoted lever connected, at a point spaced from and at one side of a pivot for said lever, with a rod which is movable to different positions;

means connecting said rod with said damper means for moving said damper means to corresponding different positions;

means connecting said actuator with said lever for moving said lever to different positions in accordance with the control signal received by said actuator;

said lever extending to the opposite side of said pivot and movable manually alternatively to said actuator; and means for removably locking said lever in different manually placed positions.

21. Apparatus as defined in claim 18, wherein said furnace is normally operated at a pressure below atmospheric and including:

a separate device having means responsive to the pressure transmitted by said first hollow pipe and means for producing a signal proportional to the pressure within said furnace;

a separate device for receiving said last-mentioned proportional signal and for producing an override signal whenever said proportional signal represents a furnace pressure approaching atmospheric within a predetermined amount; and said device which receives said first proportional signal and transmits a control signal being constructed and arranged to receive said override signal and to delay sending any further control signal until said override signal ceases.

* * * * *

UNITED STATES PATENT AND TRADEMARK OFFICE

CERTIFICATE OF CORRECTION

PATENT NO. : 4,179,265

DATED : December 18, 1979

INVENTOR(S) : Hayden P. Gildersleeve

It is certified that error appears in the above-identified patent and that said Letters Patent are hereby corrected as shown below:

Column 6, line 66, "-0.5" (first occurrence) should read -- -0.15--. Column 13, claim 7, line 31, "claim 4" should read --claim 6--. Column 14, claim 13, line 44, "claim 11" should read --claim 12--.

Signed and Sealed this

*Eighteenth* Day of *March 1980*

[SEAL]

*Attest:*

SIDNEY A. DIAMOND

*Attesting Officer*

*Commissioner of Patents and Trademarks*